US008632276B2

(12) United States Patent
Fischer

(10) Patent No.: US 8,632,276 B2
(45) Date of Patent: Jan. 21, 2014

(54) IMPLEMENT FOR PROCESSING, PARTICULARLY SEALING, GROUND SURFACES UNDER WATER, PARTICULARLY BOTTOMS AND EMBANKMENTS OF WATERWAYS, PARTICULARLY CANALS, A METHOD FOR SETTING UP THE SAME, A METHOD FOR MOVING THE SAME, A METHOD FOR SEALING GROUND SURFACES USING THE SAME, AND THE LIKE

(75) Inventor: Juergen Fischer, Kirchlinteln (DE)

(73) Assignee: Matthai Bauunternehmen GmbH & Co. KG, Verden (DE)

( * ) Notice: Subject to any disclaimer, the term of this patent is extended or adjusted under 35 U.S.C. 154(b) by 320 days.

(21) Appl. No.: 12/988,478

(22) PCT Filed: Mar. 13, 2009

(86) PCT No.: PCT/DE2009/000348

§ 371 (c)(1),
(2), (4) Date: Dec. 23, 2010

(87) PCT Pub. No.: WO2009/127181

PCT Pub. Date: Oct. 22, 2009

(65) Prior Publication Data

US 2011/0091289 A1 Apr. 21, 2011

(30) Foreign Application Priority Data

Apr. 16, 2008 (EP) ..... 08007420

(51) Int. Cl.
*E02D 13/00* (2006.01)
*E02D 7/28* (2006.01)

(52) U.S. Cl.
USPC ..... 405/232; 405/231; 405/249; 405/251; 285/188; 403/353; 138/111; 138/117

(58) Field of Classification Search
USPC ..... 405/23, 231, 232, 249, 251; 138/111, 138/115, 116, 117, 155; 403/353, 384, 387; 285/188
See application file for complete search history.

(56) References Cited

U.S. PATENT DOCUMENTS

| | | | | |
|---|---|---|---|---|
| 4,023,596 | A * | 5/1977 | Tate | 138/111 |
| 4,454,698 | A * | 6/1984 | Manzelli | 52/581 |
| 5,106,233 | A * | 4/1992 | Breaux | 405/129.8 |
| 7,575,397 | B2 * | 8/2009 | Sharapov | 405/224 |

FOREIGN PATENT DOCUMENTS

| | | | |
|---|---|---|---|
| GB | 561765 | A | 6/1944 |
| WO | WO 2006/097841 | A | 9/2006 |

OTHER PUBLICATIONS

IPRP for PCT/DE2009/000348.

* cited by examiner

*Primary Examiner* — Sean Andrish
*Assistant Examiner* — Carib Oquendo
(74) *Attorney, Agent, or Firm* — Jon L. Woodard; MacDonald, Illig, Jones & Britton LLP

(57) ABSTRACT

A method and apparatus for processing underwater beds includes a plurality of polygonal hollow pipes arranged side by side, the upper ends of which form a horizontal, substantially flat working platform. Each hollow pipe has a horizontal projection with a flange extending vertically and a corresponding flange insertion aperture with a slot immediately above it running vertically and extending as far as the upper end of the hollow pipe, the aperture being further away from the upper end of the hollow pipe than the projection with the flange and having a greater horizontal dimension than the slot. Neighboring hollow pipes engage one another via a respective projection with a corresponding slot. The hollow pipes cannot be moved relative to one another horizontally. Individual pipes can only be pulled out individually in an upward direction at the platform outer edge.

46 Claims, 20 Drawing Sheets

IMPLEMENT FOR PROCESSING, PARTICULARLY SEALING, GROUND SURFACES UNDER WATER, PARTICULARLY BOTTOMS AND EMBANKMENTS OF WATERWAYS, PARTICULARLY CANALS, A METHOD FOR SETTING UP THE SAME, A METHOD FOR MOVING THE SAME, A METHOD FOR SEALING GROUND SURFACES USING THE SAME, AND THE LIKE

BACKGROUND

The present invention relates to an apparatus for processing, especially sealing, underwater bed areas, especially banks and bottoms of waterways, such as canals, and a method for setting up such apparatuses as well as a method for moving such apparatuses. In addition, the present invention relates to a method for extensively incorporating minerals, mixtures of minerals or minerals consolidated with binders on an underwater bed area, especially banks and bottoms of waterways, such as canals, using the working apparatus, a method for removing silt from underwater bed areas, especially banks and bottoms of waterways, such as canals, using the working apparatus, a method for dredging waterways and bodies of water, especially in the tidal region, using the working apparatus, a method for creating dams in waterways and bodies of water, using the working apparatus, and equipment for driving on a working platform of the working apparatus.

In order to process beds and banks of waterways, floating equipment is used as the working platform, such as pontoons or ships. In some cases, the work is also carried out from land where possible.

Conventional working platforms are, however, difficult to position and are vulnerable to waves and currents. Another disadvantage is that beds and banks of waterways can only be processed imprecisely in this way. This is especially true with regards to installing seals. Especially in the case of clay seals, underwater, the problem arises that, after installation, such seals are left open and unprotected for lengthy periods, so that scouring and damage can be caused by waves, currents and passing ships.

SUMMARY

The present invention is thus based on the problem of providing a working apparatus or working platform which can be firmly positioned in a waterway, which is not vulnerable to waves and currents, which permits the precise processing of the bed and bank areas, and which protects a seal once installed underwater against scouring and damage caused by waves, currents and passing ships.

This problem is solved in accordance with the invention by a working apparatus for processing, especially sealing, underwater bed areas, especially banks and bottoms of waterways such as canals. A plurality of polygonal hollow pipes are arranged in parallel side by side and at least substantially without gaps, the upper ends of which form a horizontal, at least substantially flat working platform. Each hollow pipe has on its outer wall at least one projection extending substantially horizontally with a flange disposed on its outer end and extending vertically and at least one corresponding flange insertion aperture, or "plug-on aperture," with a slot immediately above it which runs vertically and extends as far as the upper end of the hollow pipe, the flange insertion aperture being disposed further away from the upper end of the hollow pipe than the projection with the flange and being of greater horizontal dimensions than the slot. Neighbouring hollow pipes are in engagement with one another via a respective projection on one of the hollow pipes with a corresponding slot in the other of the hollow pipes, such that the hollow pipes cannot be moved relative to one another in the horizontal direction and only at the outer edge of the working platform can at least one hollow pipe be pulled out individually in the vertically upward direction. The working apparatus of the invention serves to process underwater bed areas and at the same time provides a working platform which can be firmly positioned on an underwater bed area. It is therefore also contemplated to provide a working apparatus/platform or a combined working apparatus and platform.

In addition, a method is provided for setting up the working apparatus on an underwater bed area, especially beds and banks of waterways, especially canals, characterised in that it comprises:

(a) lowering a first hollow pipe on to the underwater bed area;

(b) lowering a second hollow pipe next to the first hollow pipe until the flange insertion aperture, or "plug-on aperture," of the second hollow pipe is on the same level as the flange of the first hollow pipe;

(c) thrusting the flange insertion aperture of the second hollow pipe on to the flange of the first hollow pipe;

(d) lowering the second hollow pipe on to the underwater bed area; and (e) repeating steps (b)-(d) analogously with further hollow pipes to set up the working platform.

With the method of the invention, the upper ends of the hollow pipes form a horizontal, at least substantially flat working platform, which extends above the surface of the water. In some embodiment, the working platform is preferably approx. 1 m above the water level, depending on the individual situation of the construction work, the waterway, the strength and load-bearing capacity of the bed and bank material and the tidal range.

The hollow pipes are preferably honeycomb pipes, such as hexagonal single honeycomb pipes and/or double honeycomb pipes formed from them, and optionally adapter pipes or end pipes, which in some embodiments can take the form of a one-and-a-half-fold hexagon and can be provided in order to create a relatively straight outer contour of the working platform when seen from above. In some contemplated embodiments, the honeycomb pipes are conveniently from 1,500 mm to 3,000 mm in diameter, but depending on the application and/or load to be borne, they may also be smaller or larger in diameter. The length of the honeycomb pipes is determined by the depth of the waterway or body of water to be processed, the strength and load-bearing capacity of the bed or bank material and the tidal range.

Once set up, the working apparatus can be used either as a working apparatus alone or in addition or alternatively as a working platform. If it is merely used as a working apparatus, it can be loaded and unloaded from floating equipment. Alternatively, it is also contemplated that the working apparatus is loaded and unloaded from land. If the working apparatus is used both as a working apparatus and as a working platform, it can be loaded and unloaded from the working platform itself.

If the working apparatus is also used as a working platform, it is able, when loads are applied at specific points, to spread them over a wider area on the bed or bank of a waterway, so that it is possible to drive on the working platform with a working machine, such as an excavator, to carry out work in and on the waterway.

In addition, the present invention provides a method for moving the working apparatus, characterised in that the last row of hollow pipes in the direction of movement can be pulled out upwards, one after the other, and lowered again at the front end of the working platform in the direction of movement, until the flange insertion aperture of the lowered hollow pipe is on the same level as the or a flange of a neighbouring hollow pipe. The flange insertion aperture of the lowered hollow pipe is thrust on to the flange of the neighbouring hollow pipe and subsequently the hollow pipe is lowered on to the underwater bed area and this procedure is repeated once or a number of times as required for what then becomes the last row of hollow pipes in the direction of movement. As a result, the hollow pipes are moved from the last row of hollow pipes in the direction of movement to the front end of the working platform in the direction of movement.

Additionally, the present invention provides different uses for the working apparatus of the invention and methods disclosed herein. A working machine driving on a working platform of a working apparatus includes an undercarriage and superstructure, the undercarriage having tracked running gear and the superstructure being provided with claw brackets which are designed such that they make it possible to turn the undercarriage in order to change the direction of travel of the working apparatus. While it is possible to drive on the working platform of the working apparatus of the invention with conventional working machines, such as a tracked excavator, this entails the disadvantage that the working machine damages the upper ends of the hollow pipes with the caterpillar track when it makes turning movements.

When it is necessary to change the direction of travel with the working machine of the invention, the working machine supports itself on the claw brackets, lifts itself and turns the tracked running gear. As it does so, the tracked running gear is suspended in the air on the superstructure and can turn freely without coming into contact with the working platform. Once the tracked running gear has been placed in the new direction of travel, the claw brackets are retracted again and the tracked running gear is lowered on to the working platform.

In some contemplated embodiments, the hollow pipes can, for example, be of different cross-sectional shapes. Apart from honeycomb pipes, i.e. hexagonal pipes, adapter pipes can be used in order to adapt to the particular situation or, for example, to create an at least substantially rectangular working platform.

In the method for setting up a working apparatus of the current invention, it is contemplated that at least two bulkheads can be attached to the side of the working platform. The purpose of this is to seal off bank areas for processing against waves, currents and other influences. In some embodiments, the bulkheads can be suspended in the hollow tubes and sunk into the bottom of a bank.

The invention is based on the surprising finding that using specially designed hollow pipes, a working apparatus with a working platform can be created in a simple and time-saving manner, which can be firmly positioned on the bed area of a body of water and can be dismantled, reassembled and moved or relocated in a simple and time-saving manner, and which is versatile for use in processing underwater bed areas. The system for joining the hollow pipes together is advantageously designed such that there are hollow pipes at the outer edge of the working platform which do not have any projections with flanges extending into them, so that they are particularly suitable for pouring material into the hollow pipe from above in order to deposit material on to an underwater bed area or to remove material from the underwater bed area.

In addition, it is contemplated that in some embodiments, when a hollow pipe is removed, a hollow pipe located in front of it is automatically cleared which no longer has a projection with a flange extending into it.

With the working apparatus according to the invention, it is possible to install sealing material in a controlled way and to deposit protective and ballast layers on top of it, without the sealing layer being exposed to the open water of a waterway, for example, without protection. In the method according to the invention, sealing, protective and ballast layers deposited via the hollow pipe are built first of all against existing sealing, protective and ballast layers which have already been installed and secondly against the working platform. The working apparatus offers the sealing material ideal protection against harmful influences. While the hollow pipe is being pulled out, the remaining cavities formed because of the walls of the hollow pipes close automatically as the particles of the materials deposited are redistributed in the individual layers. Similarly, other minerals, mixtures of minerals, and minerals consolidated with binders can be extensively incorporated on a bed or on banks underwater within the contemplated invention scope.

The working apparatus of the invention also enables a method for removing silt from underwater bed areas. Previous removal or disposal of silt in waterways has been accomplished by means of dredging using an excavator positioned on a working platform. Another known method consists of siphoning silt off the bed of a waterway. This method also involves a suction apparatus being mounted on a working machine, unusually an excavator, which is positioned on floating equipment. However in all such conventional methods, it has been impossible to prevent further silt from flowing from the waterway into the area already dredged. This means that it is sometimes necessary for areas that have already been dredged to be reworked several times.

In the method of the invention for removing silt using the working apparatus of the invention, silt can largely be prevented from flowing back. The silt is removed, for example, by excavating in each separate hollow pipe of the working platform. This alone is enough to prevent further silt from flowing into the hollow pipe. Furthermore, the working platform moves forwards against the direction of flow of the body of water, in the course of which the silt is removed or excavated at the rear side, away from the approaching water. This prevents further silt from flowing into areas already dredged by the working platform.

The construction of dams in waterways and bodies of water is becoming more and more important in order to protect the population, facilities, especially port facilities, the environment and nature. These dam constructions are conventionally built out from the land using a pier head system, i.e. into the water. To do this, considerable areas of land have to be made available for the construction work, at the expense of the environment and nature.

With the working apparatus of the invention, dams can also be constructed in waterways and bodies of water from the water side. For this purpose, the hollow pipes are used to install the dam building material underwater.

Just as in the method for removing silt in waterways, the deepening of waterways and bodies of water is currently performed from floating equipment if there is no possibility of carrying out the work from the land. Because of the effects of the tide, the floating equipment is dependent on particular tide times when the work can be carried out. At low tide for example, the floating equipment has to leave the work site so as not to run aground. At high tide too, the equipment has to be removed from the work site or, because of the high water level, cannot continue the work, owing to the limited range of the excavator arm.

When the working apparatus of the invention is used, work on deepening waterways and bodies of water can be carried out independently of the tide, since the excavation work is no longer dependent on the depth of the water. In some embodiments of the invention, the excavation work on the working platform of the working apparatus can also be carried out by means of a cable excavator and clamshell buckets, so that the range of the excavator arm is no longer a limiting factor. As a result of the deepening, i.e. excavation in each separate hollow pipe, the areas to be worked on can be processed precisely.

BRIEF DESCRIPTION OF THE DRAWINGS

Further features and advantages of the invention will become clear from the claims and the following description, in which the embodiments are illustrated in detail with reference to the schematic drawings in which:

DETAILED DESCRIPTION

Figure 1A:
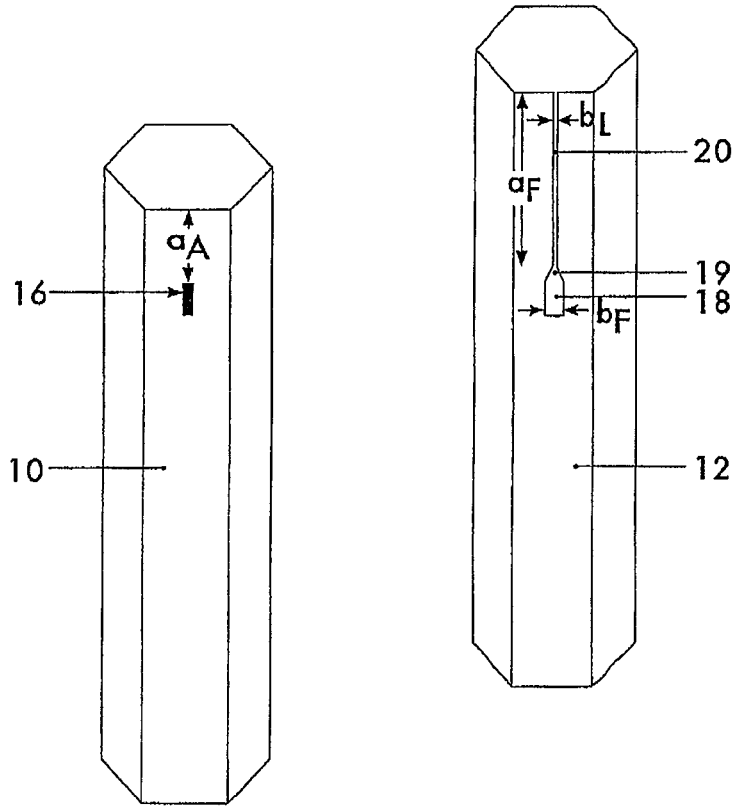
FIG. 1*a* depicts a perspective view of two hollow pipes to be joined together according to one embodiment of the invention.

FIG. 1*a* depicts two hollow pipes 10 and 12 to form a working apparatus according to one embodiment of the present invention. The hollow pipes 10 and 12 are hexagonal in cross-section and each have, at their upper ends, a projection 14 extending orthogonally to the outer wall of the hollow pipe, or horizontally (see also FIGS. 2*a* to 2*e*), with a rectangular flange 16 disposed on the outer end thereof and extending vertically, and with a corresponding flange insertion aperture, or "plug-on aperture," 18 on the opposite side, followed by a transition region 19 tapering towards the top, followed in turn by a slot 20 running vertically and extending as far as the upper end of the hollow pipe. In this case, FIG. 1*a* shows the hollow pipe 10 from the front and the hollow pipe 12 from the back. The flange insertion aperture 18 has larger horizontal dimensions $b_F$ than those $b_L$ of the slot 20. In addition, the distance $a_F$ of the flange insertion aperture 18 from the upper end of the hollow pipe 12 is greater than the distance $a_A$ of the projection 14 or flange 16 from the upper end of the hollow pipe 10.

Figure 1B:
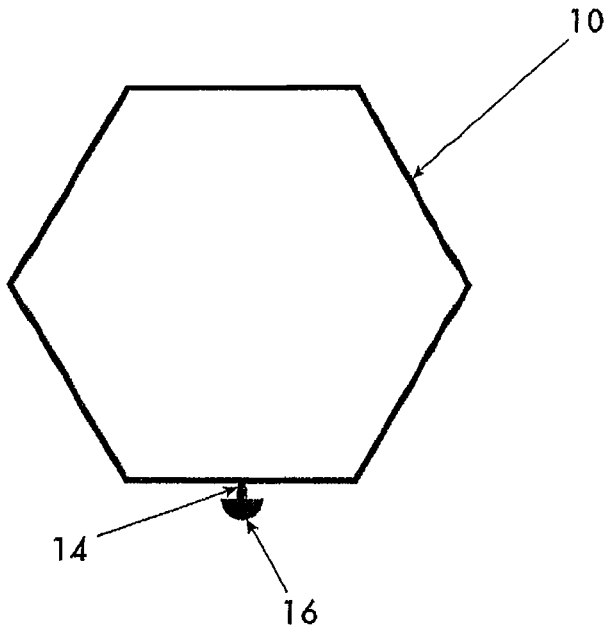
FIG. 1*b* depicts a view of a hollow pipe seen from above according to one embodiment of the invention.

FIG. 1*b* depicts a hollow pipe 10 with a projection 14 and a modified flange 16. The flange 16 is designed as a round head. It will be appreciated that in some embodiments, said projection can be substantially tapering and/or wedge shaped from said flange to its associated hollow pipe, and/or can be substantially tapering and/or wedge shaped in the vertically upward direction.

Figure 2A:
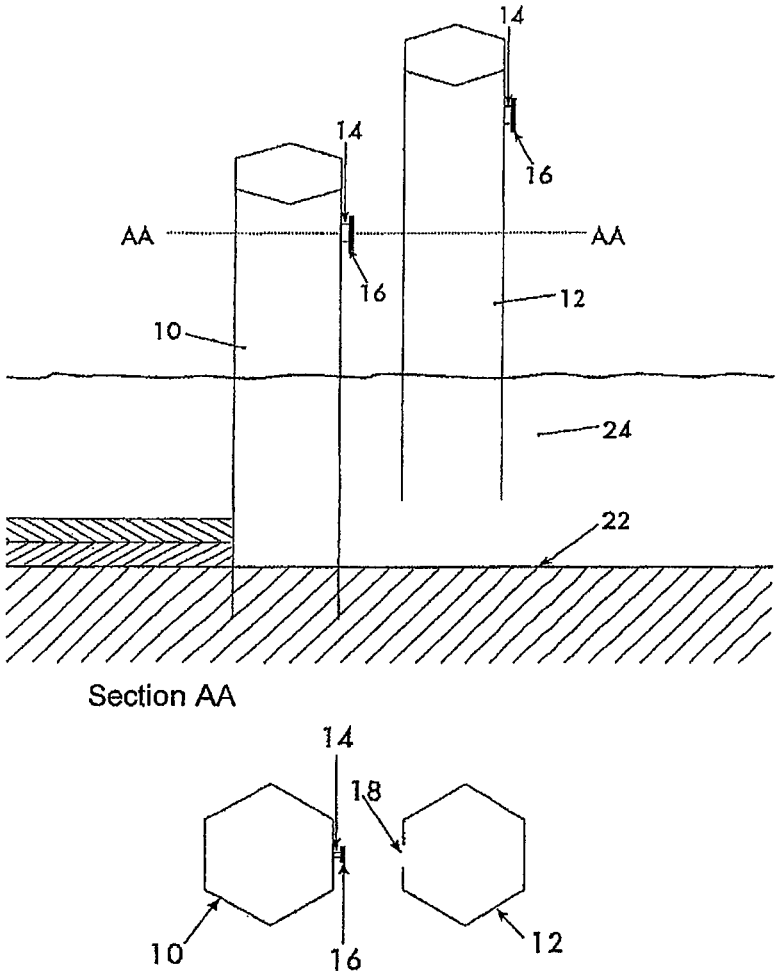
FIGS. 2*a* to 2*e* depicts various stages of fixing the two hollow pipes of FIG. 1 together.
Figure 2B:
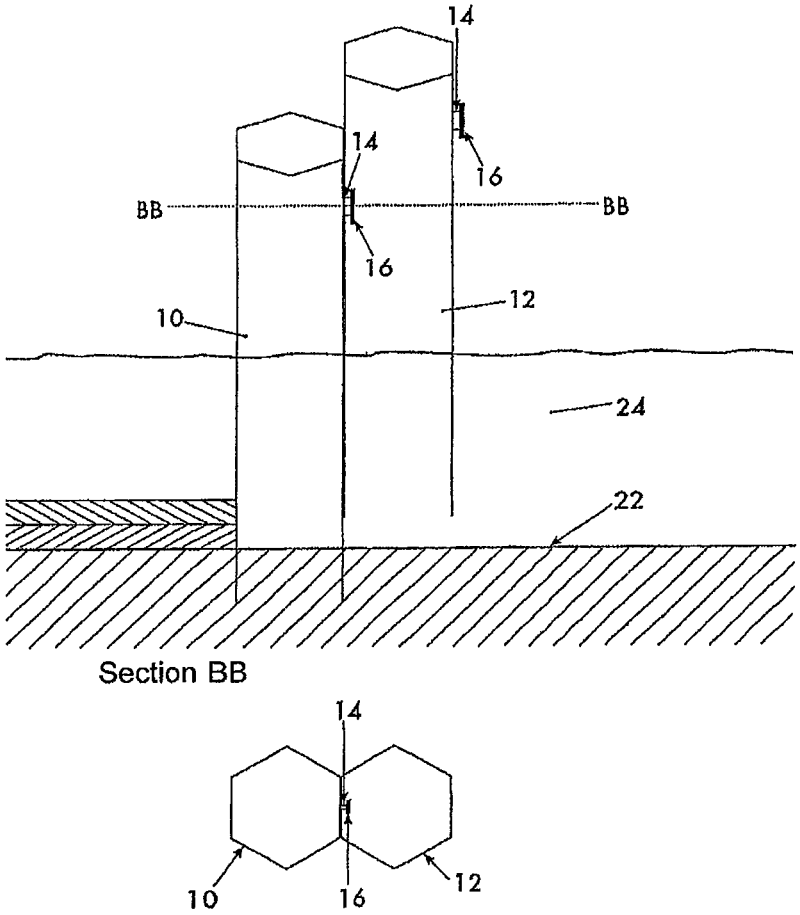
Figure 2C:
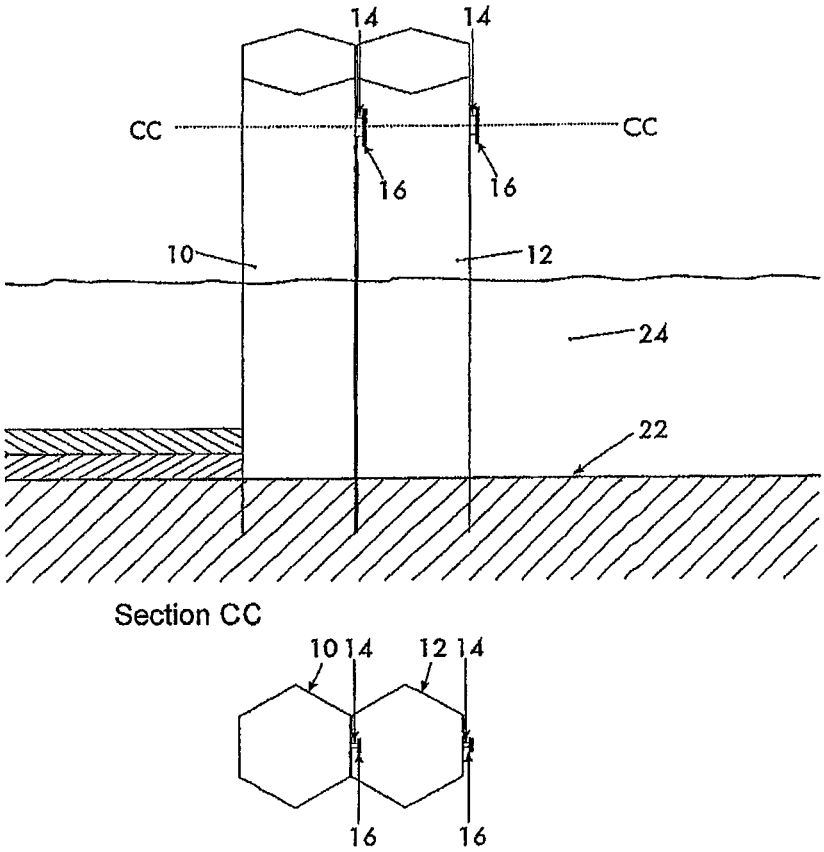
Figure 2D:
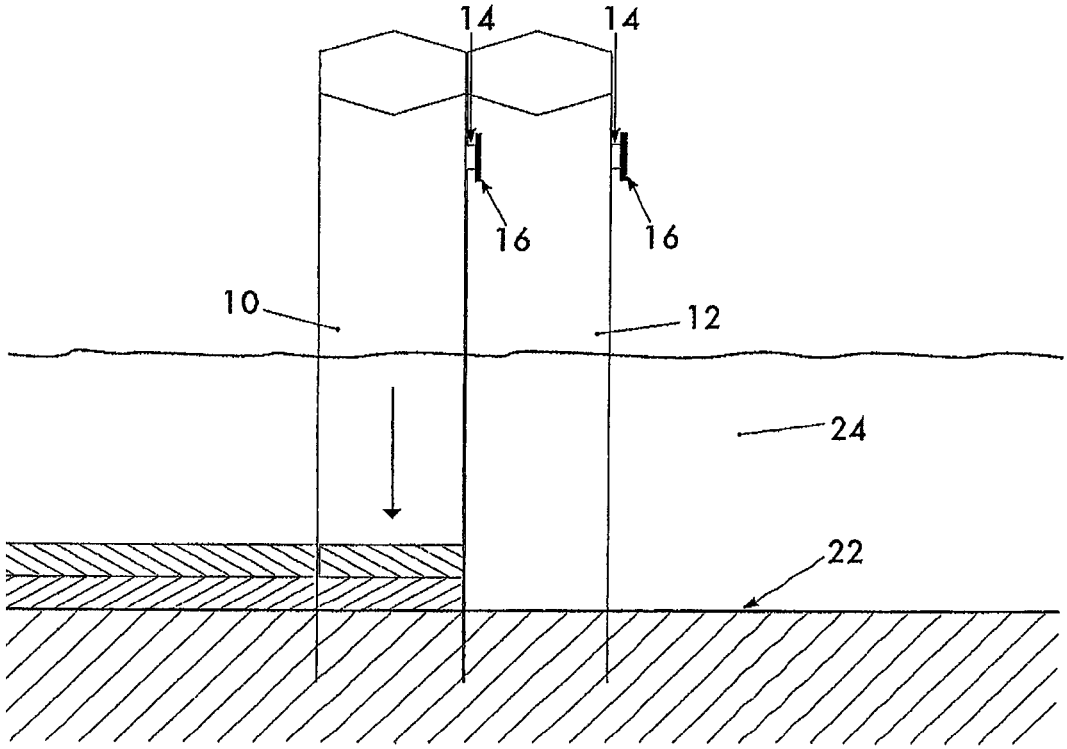
Figure 2E:
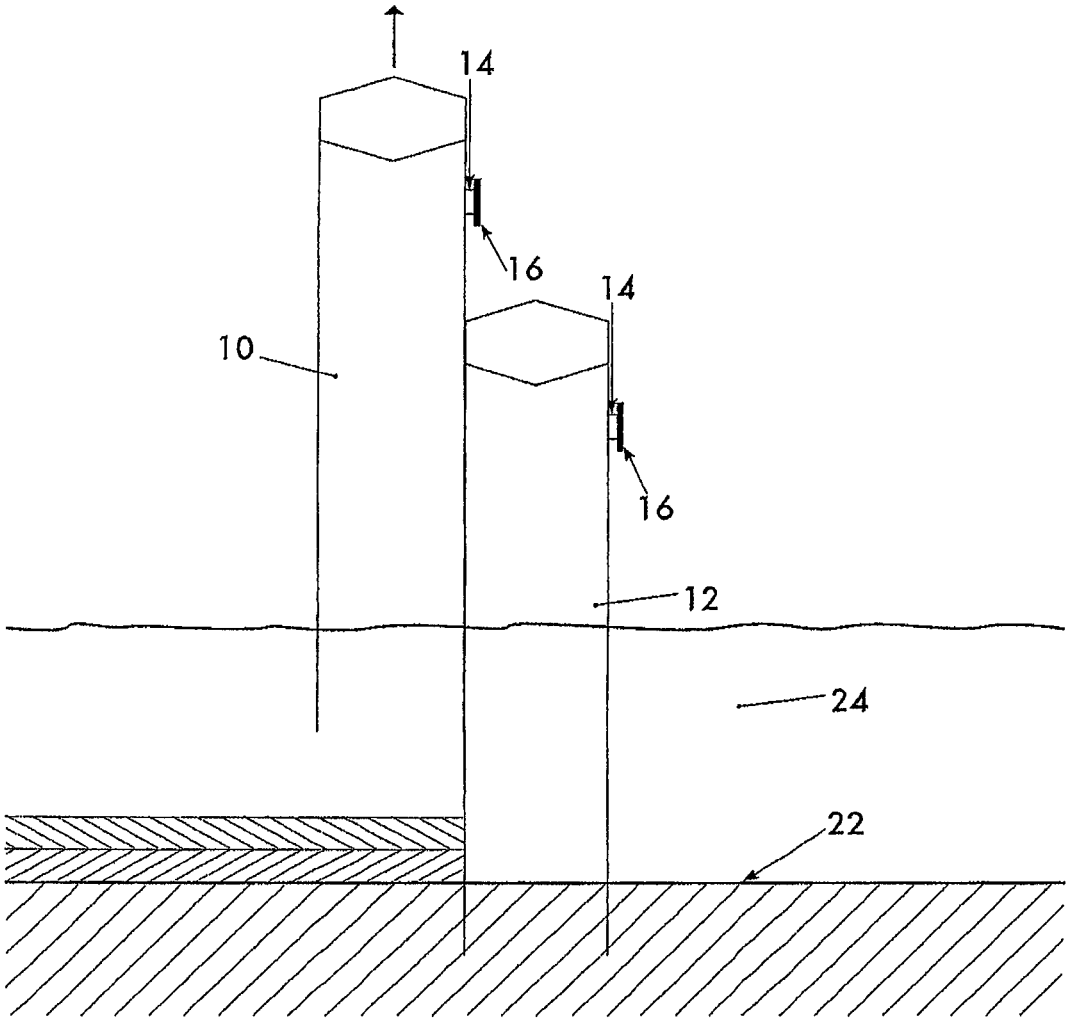

FIGS. 2*a* to 2*d* depict the procedure for setting up the working platform of a working apparatus in accordance with a contemplated embodiment of the invention, partially in a perspective view and in section view in each case. This procedure begins with lowering the hollow pipe 10 on to the bed area 22 underwater 24 (see FIG. 2*a*). After that, the hollow pipe 12 is lowered next to the hollow pipe 10, until the flange insertion aperture 18 of the hollow pipe 12 is on the same level as the flange 16 of the hollow pipe 10 (see FIG. 2*b*). The flange insertion aperture of the hollow pipe 12 is then thrust on to the flange 16 of the hollow pipe 10 (see FIG. 2*c*), after which the hollow pipe 12 is lowered on to the bed area 22 underwater 24 (see FIG. 2*d*). These steps are repeated in order to equip the working platform with further hollow pipes (not shown). In FIG. 2*e*, the hollow pipe 10 is pulled out upwards in order, for example, to relocate it at another end of the working platform or to dismantle the working platform.

Figure 3:
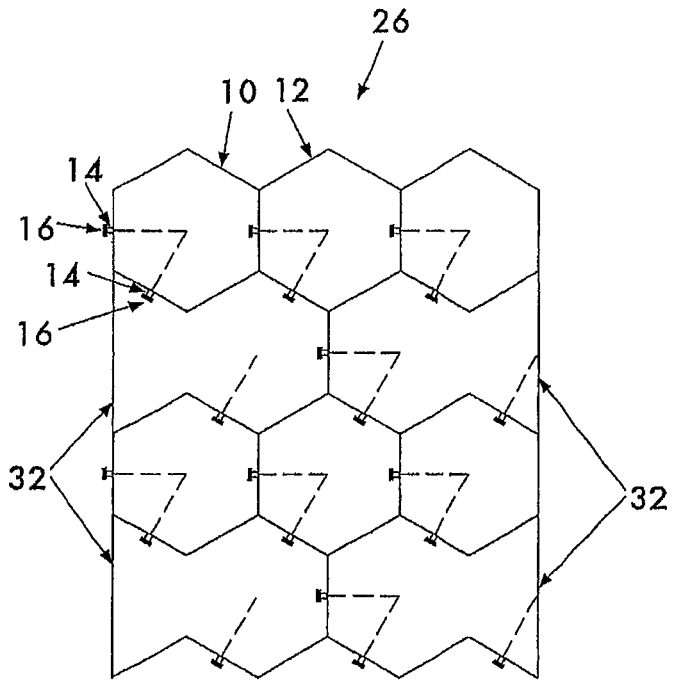
FIG. 3 depicts a view of a working platform of the working apparatus, seen from above according to one embodiment of the invention.

FIG. 3 depicts a resulting working platform 26 in a view seen from above where, in addition to the hexagonal hollow pipes 10 and 12, adapter pipes are provided, i.e. likewise hollow pipes, with the cross-section of one and a half hexagons, which have been labelled with the reference numeral 32.

Figure 4:
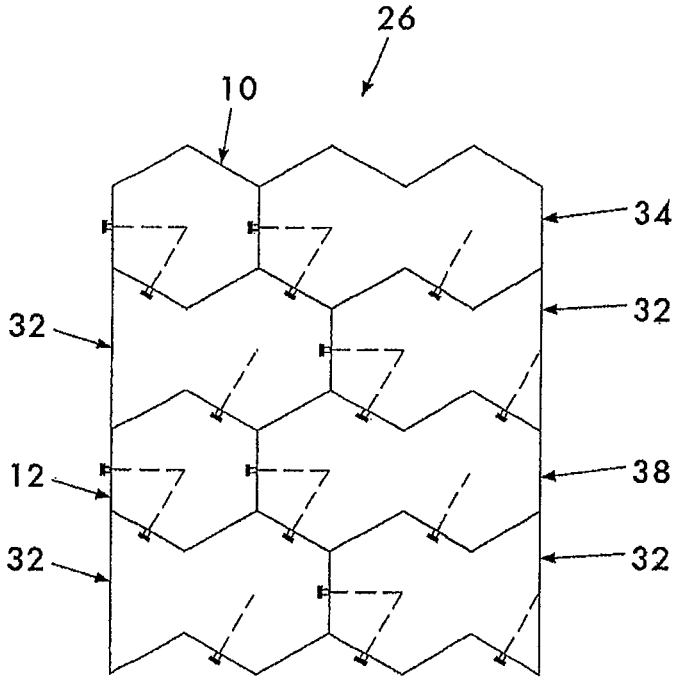
FIG. 4 depicts a view of a working platform of the working apparatus, seen from above, according to one embodiment of the invention.

FIG. 4 depicts a corresponding view, with hollow pipes having the cross-section of double hexagons, namely 34 and 38.

In FIGS. 3 and 4, the hollow pipes 10, 12 with an hexagonal cross-section each have two projections 14 with flanges (two of which have been labelled with the reference numeral 16) and two flange insertion apertures each. The projections and the flange insertion apertures are arranged opposite each other in each case.

Figure 5A:
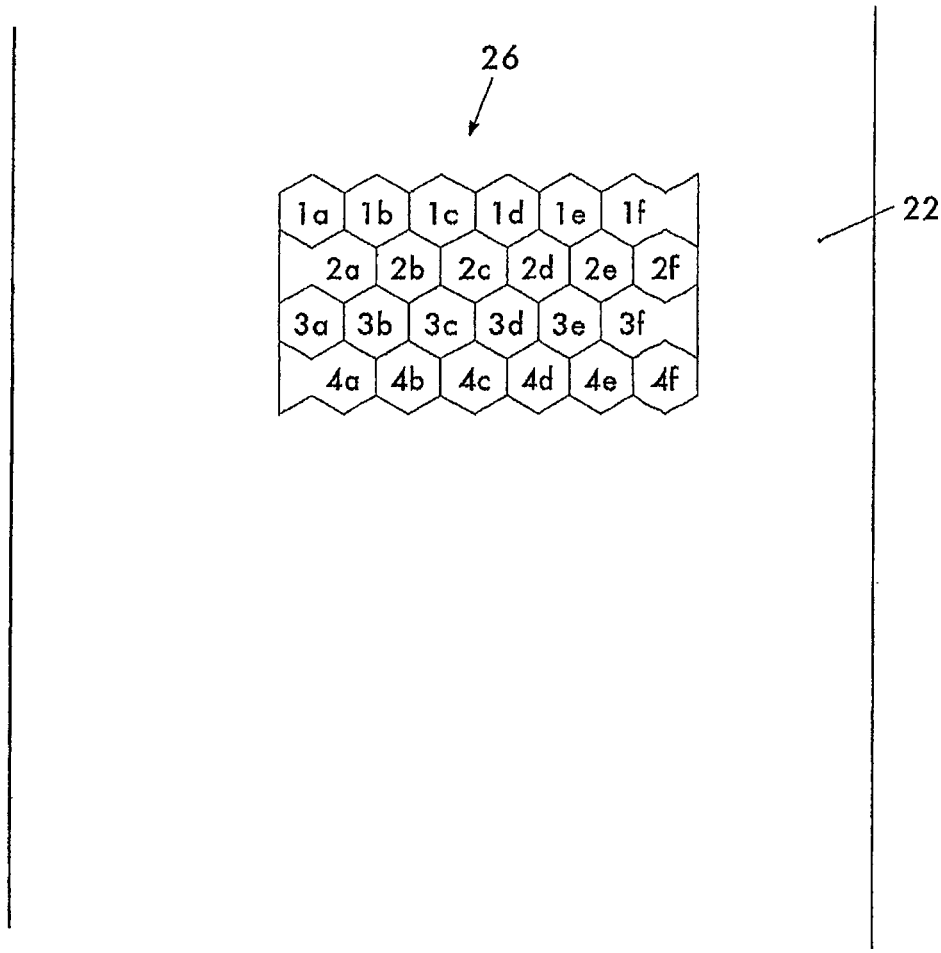
FIGS. 5*a* to 5*c* depict various stages of advancing a working platform of a working apparatus in a view seen from above, according to one embodiment of the invention.
Figure 5B:
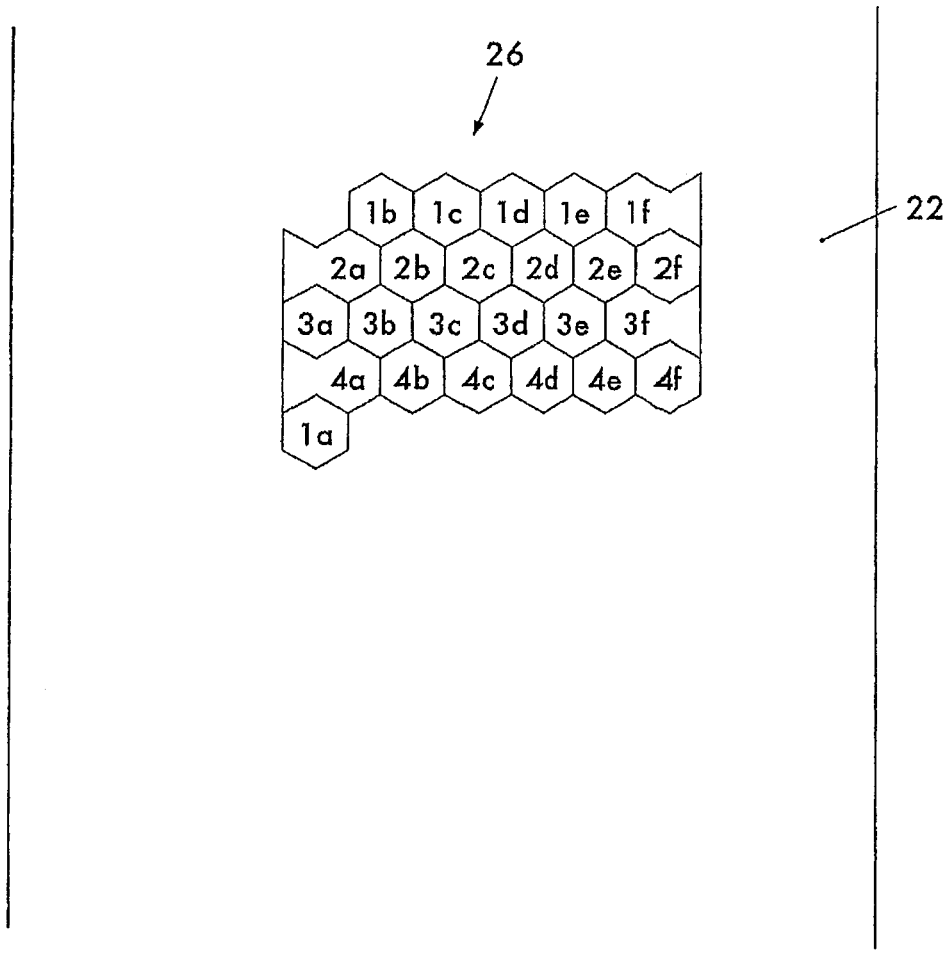
Figure 5C:
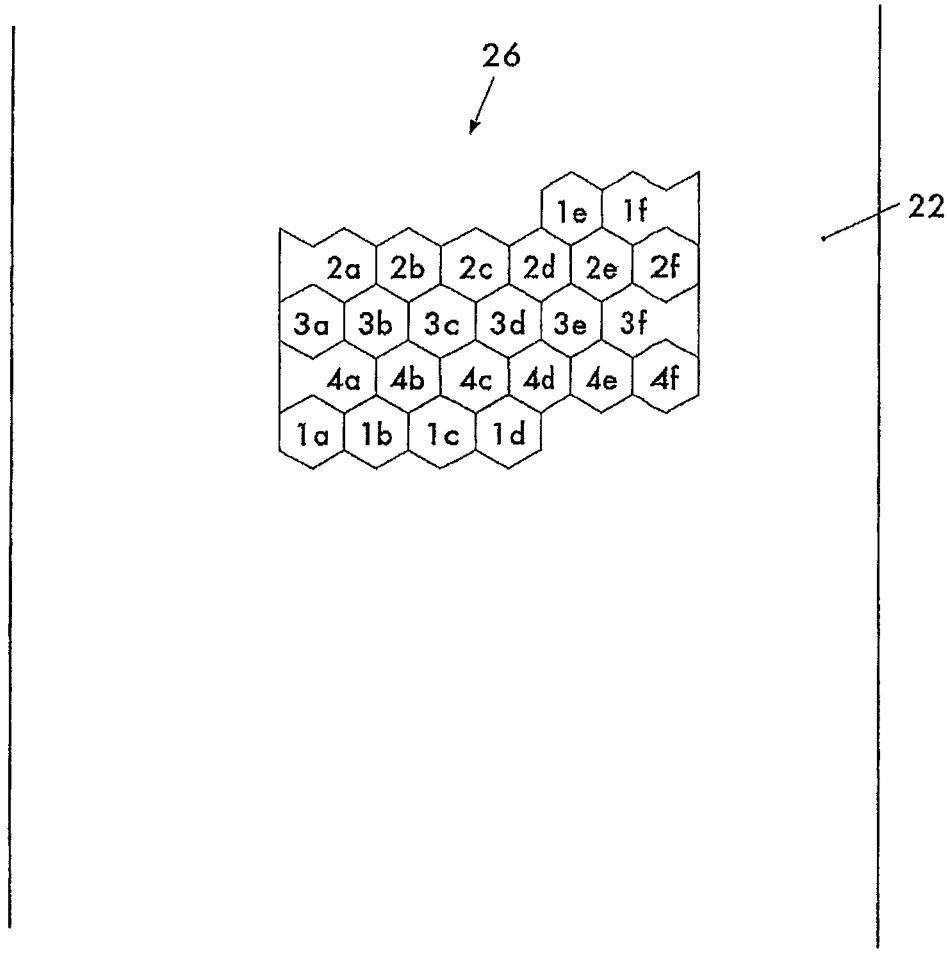

FIGS. 5*a* to 5*c* depict a method for moving the working apparatus of the invention in accordance with a particular embodiment of the invention. In order to make the Figures easier to understand, the hollow pipes are numbered by row, namely 1*a*, 1*b* . . . for the first row, 2*a*, 2*b* for the second row and so forth. In FIG. 5*a*, the hollow pipe 1*a* is in the process of being used to work on a bed area 22 underwater, such as for sealing. After use, the hollow pipe 1*a* is pulled out upwards and fixed to a hollow pipe in the fourth row, namely the hollow pipe 4*a*, in the manner shown in FIGS. 2*a* to 2*d* and described accordingly. Ultimately, therefore, the hollow pipe 1*a* is relocated. This is done for all the hollow pipes 1*a* to 1*f* of the first row in succession. These are placed one after the other next to the hollow pipes of the fourth row and fixed to them in the way already described. It follows that the working platform or the working apparatus can also be moved without any work being performed on the bed area.

FIG. 5*c* depicts the situation in which the hollow pipes 1*a* to 1*d* have already been relocated.

Figure 6A:
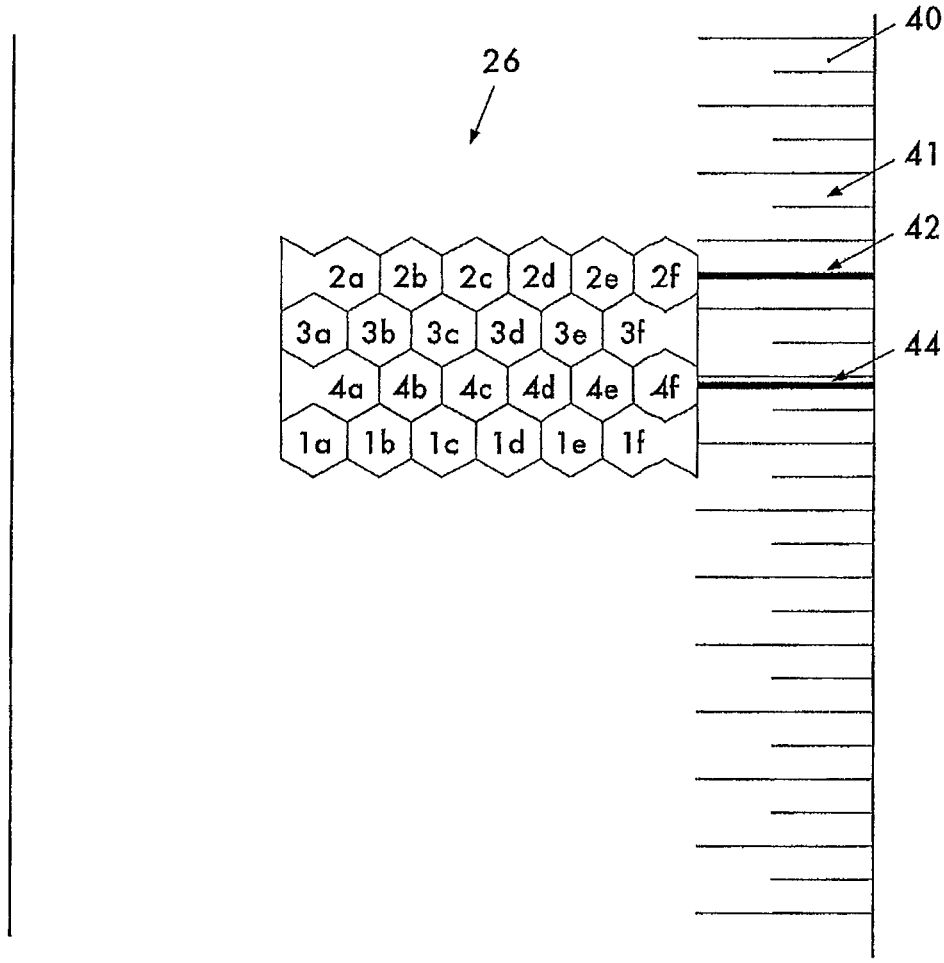
FIG. 6*a* depicts a view of a working platform of a working apparatus seen from above, according to one embodiment of the invention.
Figure 6B:
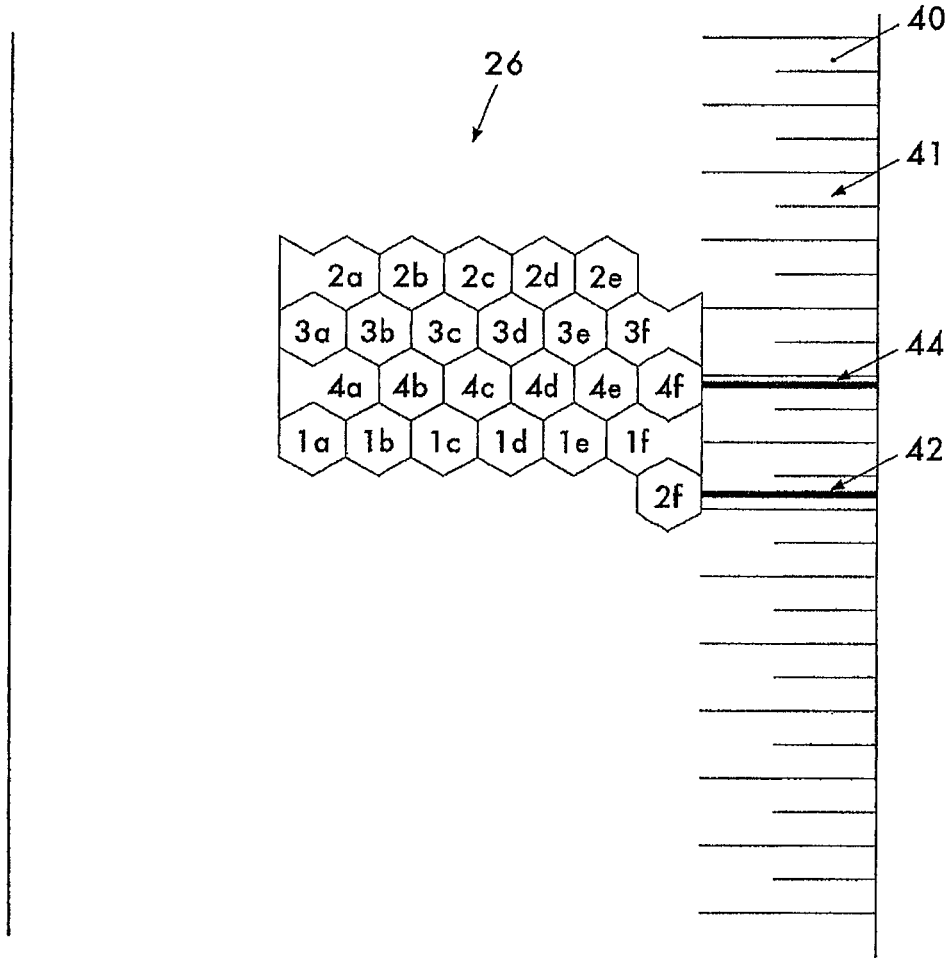
FIG. 6*b* depicts a view of a working platform of a working apparatus seen from above, according to one embodiment of the invention.

FIGS. 6*a* and 6*b* in principle show a similar procedure, but in the region of the bank 40. In this case, two bulkheads 42 and 44 are suspended in the hollow pipes 2*f* and 4*f* to the side of the working platform 26 and are sunk into the bottom of the bank 41. At the same time as the hollow pipe 2*f* is relocated, the bulkhead 42 is relocated.

Figure 7A:
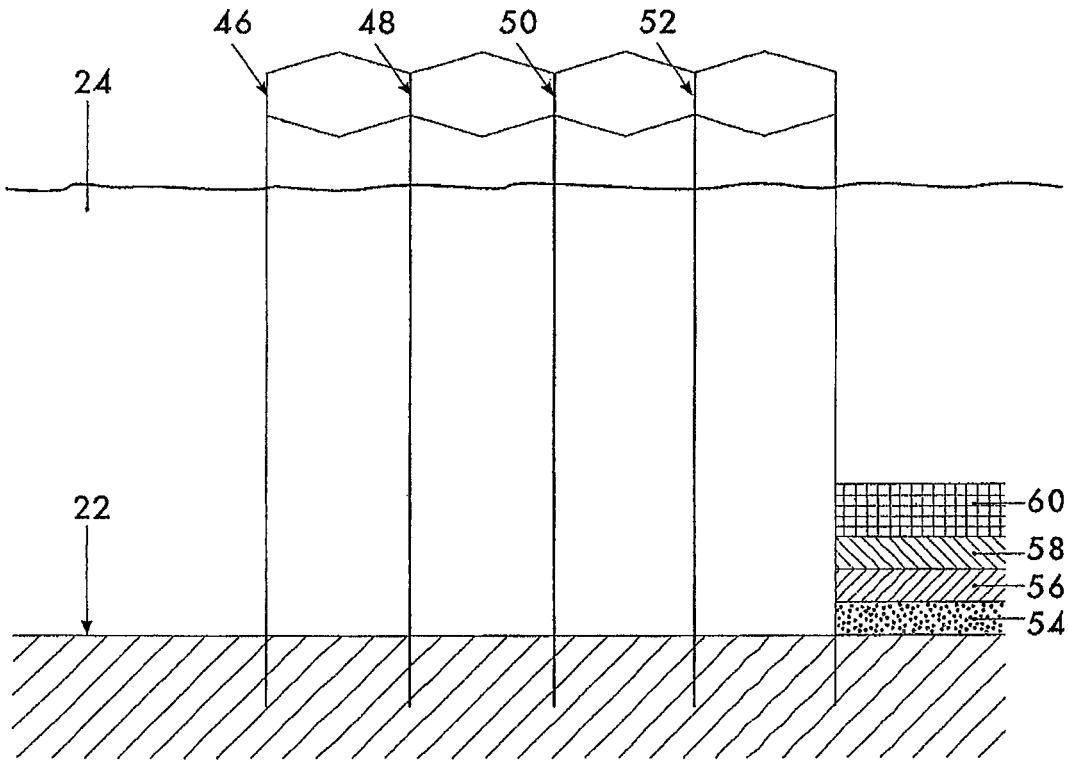
FIGS. 7*a* to 7*d* depict various stages of a method for sealing underwater bed areas according to one embodiment of the invention.
Figure 7B:
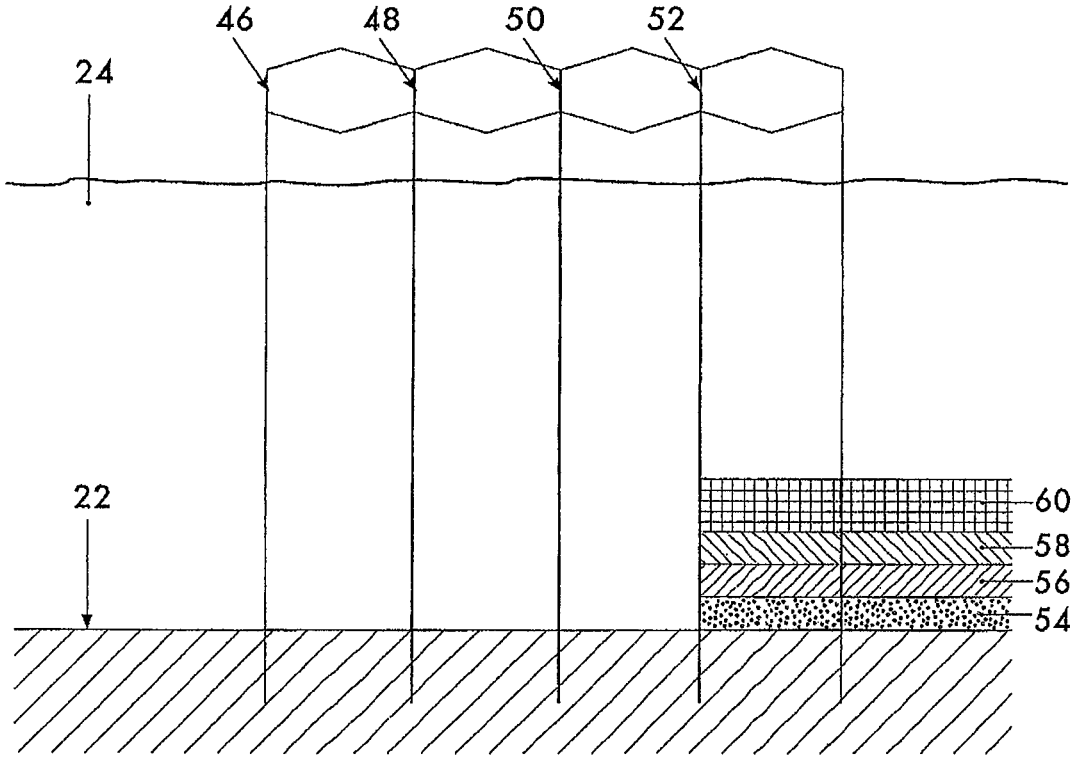
Figure 7C:
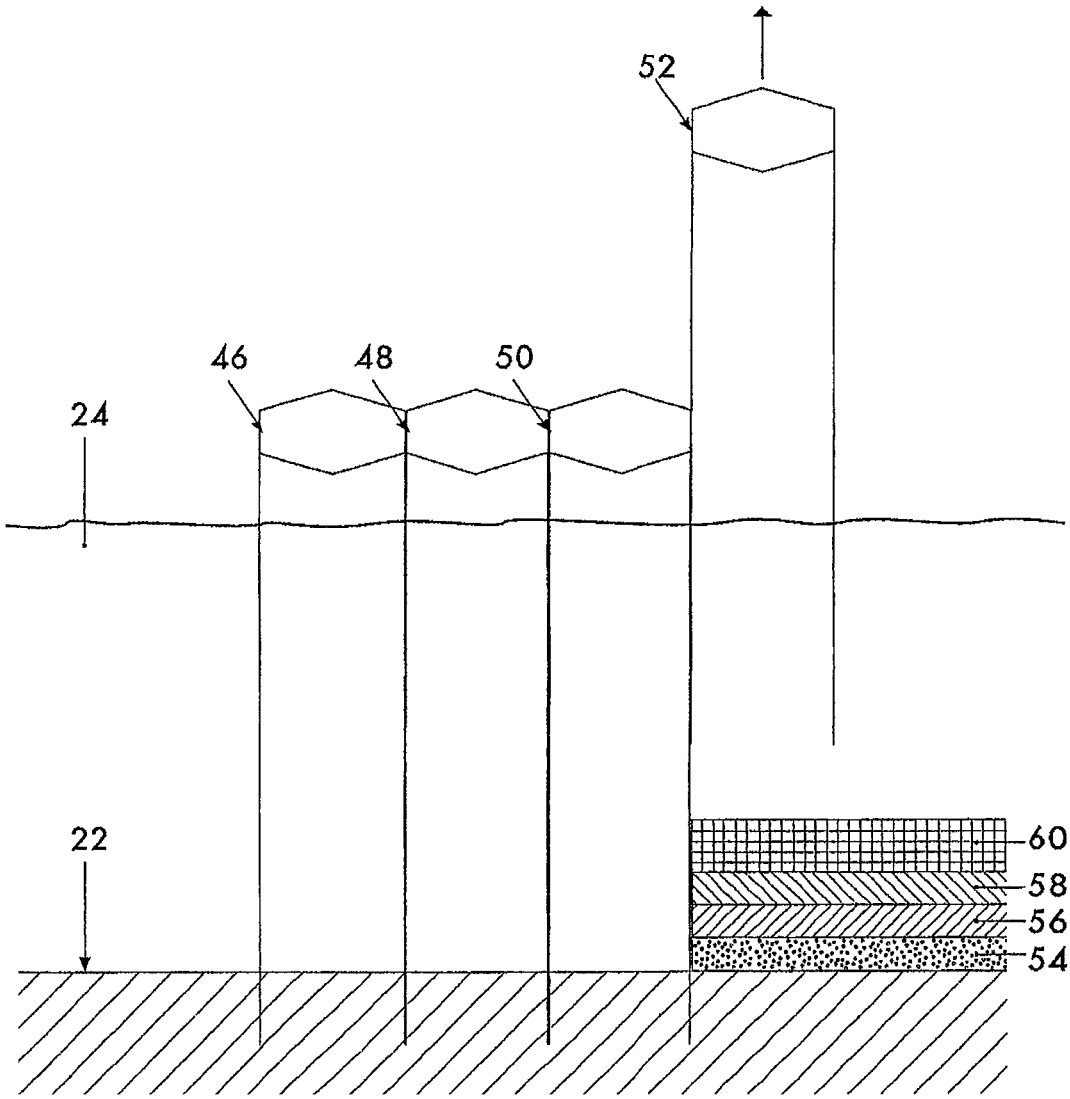
Figure 7D:
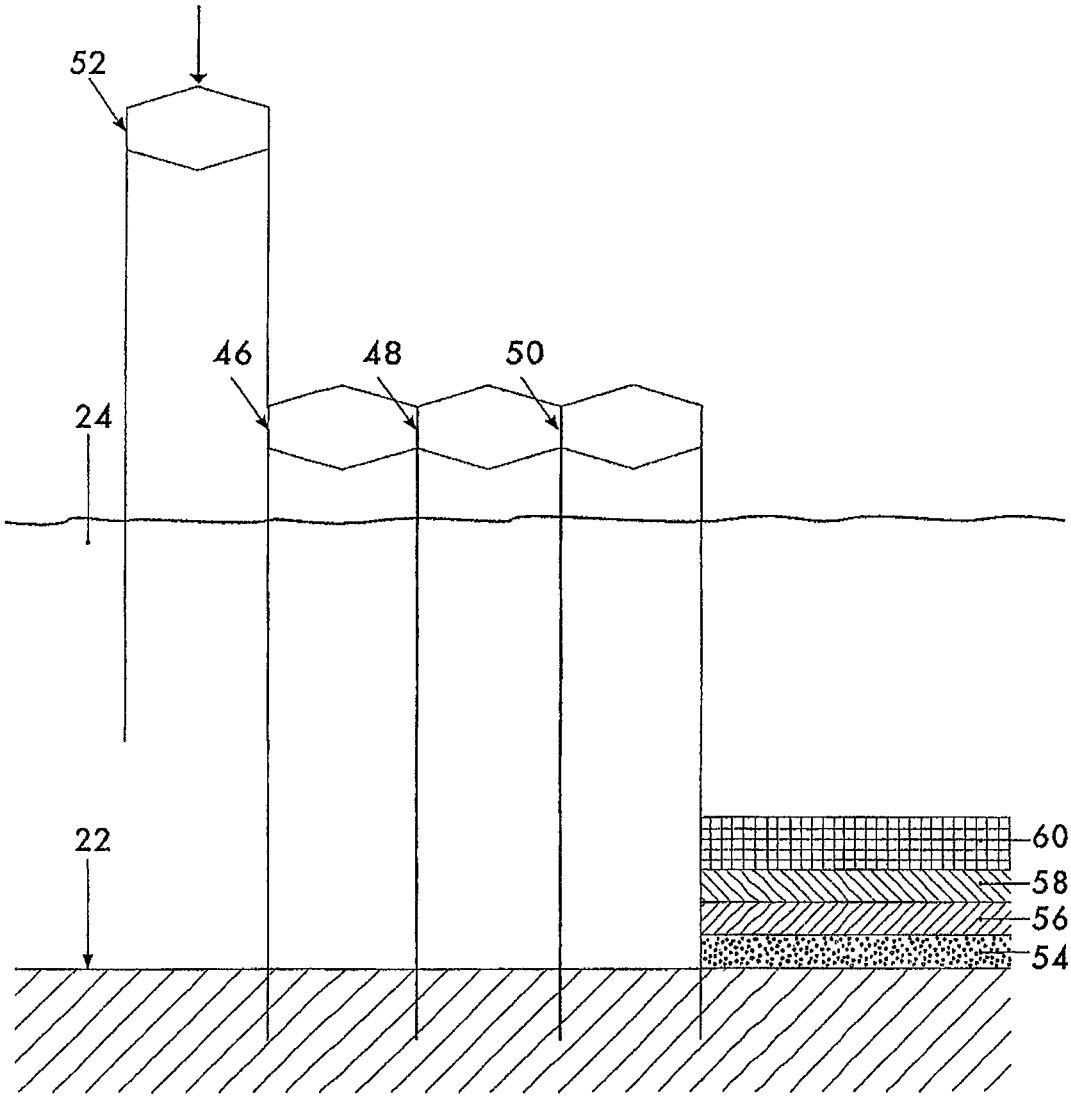

FIGS. 7*a* to 7*d* show the use of a working apparatus according to one contemplated invention embodiment when sealing a bed area 22 underwater 24. Four hollow pipes 46, 48, 50 and 52 of the working apparatus can be seen. To the right of the hollow pipes, a sealing layer 54, a filter layer 56, a filter layer 58 and a protective layer 60 of water engineering stones are deposited one on top of the other, from bottom to top. Referring to FIG. 7*b*, a corresponding layer arrangement is created by pouring corresponding materials into the hollow pipe 52. In FIG. 7*c*, the hollow pipe 52 is pulled out upwards, so that continuous layers 54 to 60 form quite quickly. The hollow pipe 52 is placed to the left of the hollow pipe 46 and then joined to it in the way described above with respect to the FIGS. 2*a* to 2*d*, as best understood by comparing FIG. 7*c* with FIG. 7*d*.

Figure 8:
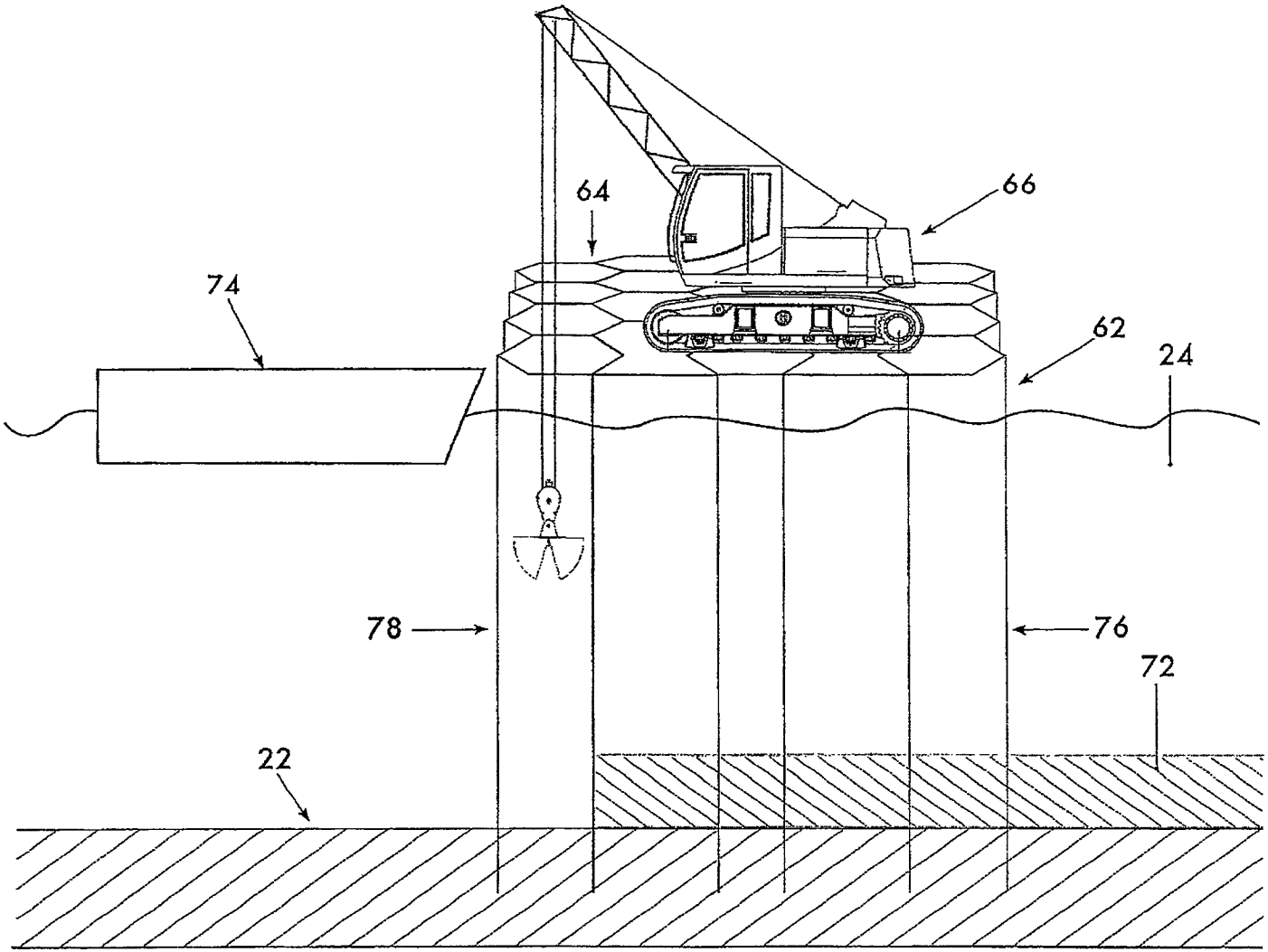
FIG. 8 depicts a method for removing silt according to one embodiment of the invention.
Figure 9:
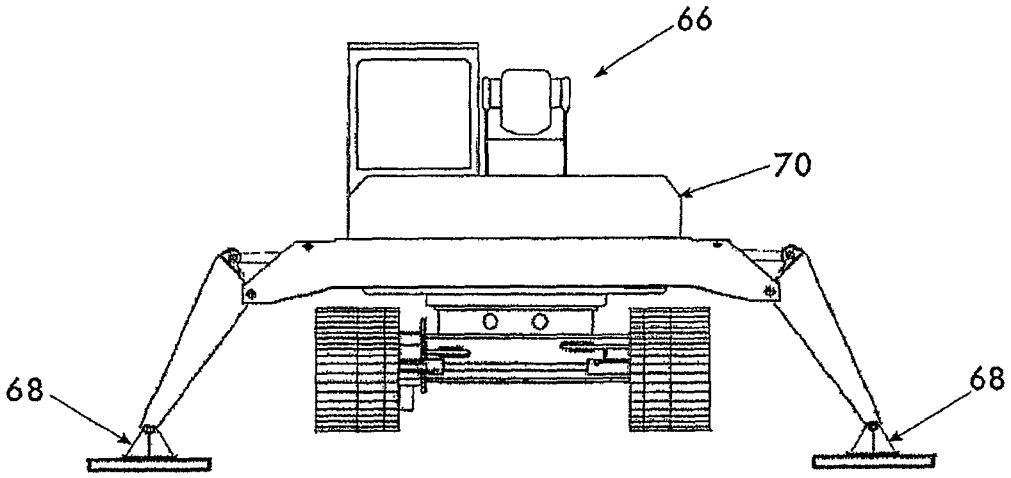
FIG. 9 depicts a view of a working machine, seen from the front, according to one embodiment of the invention.

FIG. 8 depicts a contemplated method of the invention for removing silt on the bed area 22 underwater 24, for example in a canal. A working apparatus 62 of the invention is arranged on the bed area 22. The working 62 apparatus has a working platform 64 which protrudes from the water 24. Moving on the working platform 64 is a working machine 66, namely an excavator, having claw brackets 68 on its superstructure 70, as best understood with comparison to the working machine front view in FIG. 9. This arrangement allows for a change in the direction of travel of the working machine without damaging the upper ends of the hollow pipes forming the working platform 64, as shown for example in FIGS. 2*a* to 2*d*. As can be seen from FIG. 8, the silt 72 has already been removed on the left of the working apparatus 62. The silt is transported away in a barge 74. The silt is removed by dredging in the hollow pipes of the working platform 64 on the side 78 facing away from the side 76 towards which the water is flowing. After the silt has been removed, the hollow pipes are once again relocated to the side 76 towards which the water is flowing.

The features of the invention disclosed in the present description, in the drawings and in the claims can be essential to implementing the invention in its various embodiments both individually and in any combinations.

The invention claimed is:

1. A working apparatus for processing underwater bed areas of waterways comprising:

a plurality of polygonal hollow pipes, each of said polygonal hollow pipes having an upper end and an outer wall, said polygonal hollow pipes being arranged in parallel side by side and at least substantially without gaps, said upper ends of said polygonal hollow pipes forming a horizontal, at least substantially flat working platform, said working platform having an outer edge;

each of said polygonal hollow pipes having on its said outer wall at least one projection extending substantially horizontally and a corresponding plug-on aperture, said plug-on aperture being positioned in said outer wall, said projection having an outer end and a flange disposed on said outer end, said flange extending substantially vertically, a slot being positioned immediately above said corresponding plug-on aperture, said slot running vertically and extending to said upper end of said polygonal hollow pipe;

said plug-on aperture being disposed further away from said upper end of said polygonal hollow pipe than said projection, said flange being of greater horizontal dimensions than said slot; and neighbouring said polygonal hollow pipes being in engagement with one another via a respective said projection on one of said polygonal hollow pipes with a corresponding slot in another of said polygonal hollow pipes such that said polygonal hollow pipes cannot be moved relative to one another in the horizontal direction and only at said outer edge of said working platform can at least one said polygonal hollow pipe be pulled out individually in the vertically upward direction.

2. The working apparatus of claim 1, said hollow pipes being made of one of metal, a metal alloy, and plastic.

3. The working apparatus of claim 1, said hollow pipes being identical in the shapes of their cross-sections.

4. The working apparatus of claim 1, said hollow pipes being different in the shapes of their cross-sections.

5. The working apparatus of claim 1, at least part of at least one of said hollow pipes is hexagonal.

6. The working apparatus of claim 1, at least one projection and at least one plug-on aperture of at least one said hollow pipe are disposed on opposite sides of said at least one hollow pipe.

7. The working apparatus of claim 1, said projection being substantially tapering from said flange to its associated hollow pipe.

8. The working apparatus of claim 1, said projection being substantially tapering in the vertically upward direction.

9. The working apparatus of claim 1, each said hollow pipe having:

two projections, each of said two projections having a flange; and two corresponding plug-on apertures, each of said two plug-on apertures having a slot.

10. A method for setting up a working apparatus for processing an underwater bed area of a waterway comprising:

providing a plurality of polygonal hollow pipes, each of said polygonal hollow pipes having an upper end and an outer wall;

providing on each of said polygonal hollow pipes on said outer wall at least one projection extending substantially horizontally and a corresponding flange insertion aperture, said projection having an outer end and a flange disposed on said outer end, said flange extending substantially vertically, a slot being positioned immediately above said corresponding flange insertion aperture, said slot running vertically and extending to said upper end of said hollow pipe, said flange insertion aperture being further away from said upper end of said hollow pipe than said projection, said flange being of greater horizontal dimensions than said slot;

lowering a first said polygonal hollow pipe on to the bed area underwater;

lowering a second said polygonal hollow pipe next to the first said hollow pipe until the flange insertion aperture of the second said polygonal hollow pipe is on the same level as the flange of the first said polygonal hollow pipe; and thrusting the flange insertion aperture of the second said polygonal hollow pipe on to the flange of the first said polygonal hollow pipe, and lowering the second said polygonal hollow pipe on to the bed area underwater, to arrange the first said polygonal hollow pipe and the second said polygonal hollow pipe in parallel, side by side, and at least substantially without gaps between the first and second said polygonal hollow pipes, and to position said upper ends of the first and second said polygonal hollow pipes to form a horizontal, at least substantially flat working platform.

11. The method of claim 10 further comprising:

lowering a third said hollow pipe next to the second said hollow pipe until the flange insertion aperture of the third said hollow pipe is on the same level as the flange of the second said hollow pipe; and thrusting the flange insertion aperture of the third said hollow pipe on to the flange of the second said hollow pipe, and lowering the third said hollow pipe on to the bed area underwater, to arrange the second said hollow pipe and the third said hollow pipe in parallel, side by side, and at least substantially without gaps between the second and third said hollow pipes, and to position said upper ends of the first, second, and third said hollow pipes to form a horizontal, at least substantially flat working platform, said working platform having an outer edge such that said hollow pipes cannot be moved relative to one another in the horizontal direction and only at said outer edge of said working platform can at least one of said hollow pipes be pulled out individually in the vertically upward direction.

12. The method of claim 10, the working platform comprising at least four of said hollow pipes.

13. The method of claim 10, at least two bulkheads being attached to a side of the working platform.

14. The method of claim 13, the bulkheads being suspended in the hollow pipes and being sunk into the bottom of the bank.

15. The method of claim 11 further comprising a last row of said hollow pipes in a direction of movement can be pulled out upwards, one after the other, and lowered again at a front end of the working platform in the direction of movement, until the flange insertion aperture of the third said hollow pipe is on the same level as the flange of the second said hollow pipe, the flange insertion aperture of the third said hollow pipe is thrust on to the flange of the second said hollow pipe and subsequently the third said hollow pipe is lowered on to the underwater bed area to form the last row of hollow pipes in the direction of movement.

16. The method of claim 10 further comprising setting up said working apparatus on a bed area that is a bank.

17. The method of claim 10 further comprising setting up said working apparatus in a waterway that is a canal.

18. A method for setting up a working apparatus for processing an underwater bed area of a waterway comprising:

providing a plurality of polygonal hollow pipes, each of said polygonal hollow pipes having an upper end and an outer wall;

providing on each of said polygonal hollow pipes on said outer wall at least one projection extending substantially horizontally and a corresponding flange insertion aperture, said projection having an outer end and a flange disposed on said outer end, said flange extending substantially vertically, a slot being positioned immediately above said corresponding flange insertion aperture, said slot running vertically and extending to said upper end of said polygonal hollow pipe, said flange insertion aperture being further away from said upper end of said polygonal hollow pipe than said projection, said flange being of greater horizontal dimensions than said slot;

lowering a first said polygonal hollow pipe on to the bed area underwater;

lowering a second said polygonal hollow pipe next to the first said polygonal hollow pipe until the flange insertion aperture of the second said polygonal hollow pipe is on the same level as the flange of the first said polygonal hollow pipe;

thrusting the flange insertion aperture of the second said polygonal hollow pipe on to the flange of the first said polygonal hollow pipe and lowering the second said polygonal hollow pipe on to the bed area underwater, to arrange the first said polygonal hollow pipe and the second said polygonal hollow pipe in parallel, side by side, and at least substantially without gaps between the first and second said polygonal hollow pipes, and to position said upper ends of the first and second said polygonal hollow pipes to form a horizontal, at least substantially flat working platform, said working platform having an outer edge;

pouring a self-sealing, pourable sealing material to create a sealing layer into the second said polygonal hollow pipe which can be pulled out upwards individually and which is located at the outer edge of the working platform;

pouring a protective material into the second said polygonal hollow pipe to create at least one protective layer on the sealing layer;

pulling the second said polygonal hollow pipe upwards out of the working platform;

lowering the second said polygonal hollow pipe in a different area of the outer edge of the working platform until the flange insertion aperture of the second said polygonal hollow pipe is on the same level as the flange of a third said polygonal hollow pipe;

thrusting the flange insertion aperture of the second said polygonal hollow pipe on to the flange of the third said polygonal hollow pipe; and lowering the second said polygonal hollow pipe on to the bed area underwater.

19. The method of claim 18, the working platform comprising at least four of said hollow pipes.

20. The method of claim 18 further comprising lowering the second said hollow pipe in an opposite area of the outer edge of the working platform.

21. The method of claim 18 further comprising setting up said underwater apparatus on a bed area that is a bank.

22. The method of claim 18 further comprising setting up said underwater apparatus in a waterway that is a canal.

23. The method of claim 18, the sealing material comprising a plurality of three-dimensional bodies, each said three-dimensional body comprising:

an homogenized blend of clayey soil mixture; and at least one swellable material which swells upon contact with water.

24. The method of claim 23, said plurality of three-dimensional bodies being at least one of disk-shaped and platey.

25. The method of claim 18, the sealing material comprising processed soil mixture mixed with at least one swellable material which swells upon contact with water.

26. The method of claim 25, the at least one swellable material being at least one of bentonite powder, bentonite beads, and bentonite pellets.

27. The method of claim 18, the at least one protective layer being at least one of a filter layer and a layer of water engineering stones.

28. The method of claim 18, further comprising pouring in a separating material into the second said hollow pipe directly on to the sealing layer, before pouring in said sealing material, in order to create a separating layer.

29. The method of claim 28, said separating material being prepared from clay chips.

30. The method of claim 18, further comprising pouring in a separating material into the second said hollow pipe before the sealing material is poured in, in order to create a separating layer.

31. The method of claim 30, said separating material being prepared from clay chips.

32. The method of claim 30, the separating material being poured on to a subgrade.

33. A method for extensively incorporating minerals, mixtures of minerals and minerals consolidated with binders on a bed area underwater, using a working apparatus, the method comprising:

providing a plurality of polygonal hollow pipes, each of said polygonal hollow pipes having an upper end and an outer wall;

providing on each of said polygonal hollow pipes on said outer wall at least one projection extending substantially horizontally and a corresponding flange insertion aperture, said projection having an outer end and a flange disposed on said outer end, said flange extending substantially vertically, a slot being positioned immediately above said corresponding flange insertion aperture, said slot running vertically and extending to said upper end of said polygonal hollow pipe, said flange insertion aperture being further away from said upper end of said polygonal hollow pipe than said projection, said flange being of greater horizontal dimensions than said slot;

lowering a first said polygonal hollow pipe on to the bed area underwater;

lowering a second said polygonal hollow pipe next to the first said polygonal hollow pipe until the flange insertion aperture of the second said polygonal hollow pipe is on the same level as the flange of the first said polygonal hollow pipe;

thrusting the flange insertion aperture of the second said polygonal hollow pipe on to the flange of the first said polygonal hollow pipe, and lowering the second said polygonal hollow pipe on to the bed area underwater, to arrange the first said polygonal hollow pipe and the second said polygonal hollow pipe in parallel, side by side, and at least substantially without gaps between the first and second said polygonal hollow pipes, and to position said upper ends of the first and second said polygonal hollow pipes to form a horizontal, at least substantially flat working platform, said working platform having an outer edge;

pouring at least one of a mineral, a mixture of minerals, a mineral consolidated with binders, and a mixture of minerals consolidated with binders to create a corresponding layer in the second said polygonal hollow pipe which is located at the outer edge of the working platform and which can be pulled out upwards individually;

pulling the second said polygonal hollow pipe upwards out of the working platform;

lowering the second said polygonal hollow pipe in a different area of the outer edge of the working platform until the flange insertion aperture of the second said polygonal hollow pipe is on the same level as the flange of a third said polygonal hollow pipe;

thrusting the flange insertion aperture of the second said polygonal hollow pipe on to the flange of the third said polygonal hollow pipe; and lowering the second said polygonal hollow pipe on to the bed area underwater.

34. The method of claim 33, the working platform comprising at least four of said hollow pipes.

35. The method of claim 33 further comprising setting up said working apparatus on a bed area that is a bank.

36. The method of claim 33 further comprising setting up said working apparatus in a waterway that is a canal.

37. A method for removing silt from bed areas underwater using a working apparatus, the method comprising:

providing a plurality of polygonal hollow pipes, each of said polygonal hollow pipes having an upper end and an outer wall;

providing on each of said polygonal hollow pipes on said outer wall at least one projection extending substantially horizontally and a corresponding flange insertion aperture, said projection having an outer end and a flange disposed on said outer end, said flange extending substantially vertically, a slot being positioned immediately above said corresponding flange insertion aperture, said slot running vertically and extending to said upper end of said polygonal hollow pipe, said flange insertion aperture being further away from said upper end of said polygonal hollow pipe than said projection, said flange being of greater horizontal dimensions than said slot;

lowering a first said polygonal hollow pipe on to the bed area underwater;

lowering a second said polygonal hollow pipe next to the first said polygonal hollow pipe until the flange insertion aperture of the second said polygonal hollow pipe is on the same level as the flange of the first said polygonal hollow pipe;

thrusting the flange insertion aperture of the second said polygonal hollow pipe on to the flange of the first said polygonal hollow pipe, and lowering the second said polygonal hollow pipe on to the bed area underwater, to arrange the first said polygonal hollow pipe and the second said polygonal hollow pipe in parallel, side by side, and at least substantially without gaps between the first and second said polygonal hollow pipes, and to position said upper ends of the first and second said polygonal hollow pipes to form a horizontal, at least substantially flat working platform, said working platform having an outer edge;

removing silt from the second said polygonal hollow pipe which can be pulled out upwards individually and which is located on the outer edge of the working platform opposite a side of the working platform towards which the water is flowing;

pulling the second said polygonal hollow pipe upwards out of the working platform;

lowering the second said polygonal hollow pipe at the outer edge of the working platform on the side towards which the water is flowing, until the flange insertion aperture of the second said polygonal hollow pipe is on the same level as the flange of a third said polygonal hollow pipe;

thrusting the flange insertion aperture of the second said polygonal hollow pipe on to the flange of the third said polygonal hollow pipe; and lowering the second said polygonal hollow pipe on to the bed area underwater.

38. The method of claim 37, the working platform comprising at least four of said hollow pipes.

39. The method of claim 37 further comprising setting up said working apparatus on a bed area that is a bank.

40. The method of claim 37 further comprising setting up said working apparatus in a waterway that is a canal.

41. A method for dredging waterways and bodies of water using a working apparatus, the method comprising:

providing a plurality of polygonal hollow pipes, each of said polygonal hollow pipes having an upper end and an outer wall;

providing on each of said polygonal hollow pipes on said outer wall at least one projection extending substantially horizontally and a corresponding flange insertion aperture, said projection having an outer end and a flange disposed on said outer end, said flange extending substantially vertically, a slot being positioned immediately above said corresponding flange insertion aperture, said slot running vertically and extending to said upper end of said polygonal hollow pipe, said flange insertion aperture being further away from said upper end of said polygonal hollow pipe than said projection, said flange being of greater horizontal dimensions than said slot;

lowering a first said polygonal hollow pipe on to the bed area underwater;

lowering a second said polygonal hollow pipe next to the first said polygonal hollow pipe until the flange insertion aperture of the second said polygonal hollow pipe is on the same level as the flange of the first said polygonal hollow pipe;

thrusting the flange insertion aperture of the second said polygonal hollow pipe on to the flange of the first said polygonal hollow pipe, and lowering the second said polygonal hollow pipe on to the bed area underwater, to arrange the first said polygonal hollow pipe and the second said polygonal hollow pipe in parallel, side by side, and at least substantially without gaps between the first and second said polygonal hollow pipes, and to position said upper ends of the first and second said polygonal hollow pipes to form a horizontal, at least substantially flat working platform, said working platform having an outer edge;

setting up the working apparatus in the tidal region;

dredging material out of the second said polygonal hollow pipe which can be pulled out upwards individually;

pulling the second said polygonal hollow pipe upwards out of the working platform;

lowering the second said polygonal hollow pipe in a different area of the outer edge of the working platform;

thrusting the flange insertion aperture of the second said polygonal hollow pipe on to the flange of the third said polygonal hollow pipe; and lowering the second said polygonal hollow pipe on to the bed area underwater.

42. The method of claim 41, the working platform comprising at least four of said hollow pipes.

43. A method for creating dams in waterways and bodies of water using a working apparatus comprising:

providing a plurality of polygonal hollow pipes, each of said polygonal hollow pipes having an upper end and an outer wall;

providing on each of said polygonal hollow pipes on said outer wall at least one projection extending substantially horizontally and a corresponding flange insertion aperture, said projection having an outer end and a flange disposed on said outer end, said flange extending substantially vertically, a slot being positioned immediately above said corresponding flange insertion aperture, said slot running vertically and extending to said upper end of said polygonal hollow pipe, said flange insertion aperture being further away from said upper end of said polygonal hollow pipe than said projection, said flange being of greater horizontal dimensions than said slot;

lowering a first said polygonal hollow pipe on to the bed area underwater;

lowering a second said polygonal hollow pipe next to the first said polygonal hollow pipe until the flange insertion aperture of the second said polygonal hollow pipe is on the same level as the flange of the first said polygonal hollow pipe;

thrusting the flange insertion aperture of the second said polygonal hollow pipe on to the flange of the first said polygonal hollow pipe, and lowering the second said polygonal hollow pipe on to the bed area underwater, to arrange the first said polygonal hollow pipe and the second said polygonal hollow pipe in parallel, side by side, and at least substantially without gaps between the first and second said polygonal hollow pipes, and to position said upper ends of the first and second said polygonal hollow pipes to form a horizontal, at least substantially flat working platform, said working platform having an outer edge;

pouring a dam building material into the second said polygonal hollow pipe which can be pulled out upwards individually and is located at the outer edge of the working platform;

pulling the second said polygonal hollow pipe upwards out of the working platform;

lowering the second said polygonal hollow pipe in an opposite area of the outer edge of the working platform until the flange insertion aperture of the second said polygonal hollow pipe is on the same level as the flange of a third said polygonal hollow pipe;

thrusting the flange insertion aperture of the second said polygonal hollow pipe on to the flange of the third said polygonal hollow pipe; and lowering the second said polygonal hollow pipe on to the bed area underwater.

44. The method of claim 43, the working platform comprising at least four of said hollow pipes.

45. A working apparatus for processing underwater bed areas of waterways comprising:

a plurality of polygonal hollow pipes, each of said polygonal hollow pipes having an upper end and an outer wall, said polygonal hollow pipes being arranged in parallel side by side and at least substantially without gaps, said upper ends of said polygonal hollow pipes forming a horizontal, at least substantially flat working platform, said working platform having an outer edge;

each of said polygonal hollow pipes having on its said outer wall at least one projection extending substantially horizontally and a corresponding flange insertion aperture, said projection having an outer end and a flange disposed on said outer end, said flange extending substantially vertically, a slot being positioned immediately above said corresponding flange insertion aperture, said slot running vertically and extending to said upper end of said polygonal hollow pipe;

said flange insertion aperture being disposed further away from said upper end of said polygonal hollow pipe than said projection, said flange being of greater horizontal dimensions than said slot;

neighbouring said polygonal hollow pipes being in engagement with one another via a respective said projection on one of said polygonal hollow pipes with a corresponding slot in another of said polygonal hollow pipes such that said polygonal hollow pipes cannot be moved relative to one another in the horizontal direction and only at said outer edge of said working platform can at least one said polygonal hollow pipe be pulled out individually in the vertically upward direction; and a working machine for driving on said working platform, said working machine having an undercarriage and a superstructure, the undercarriage having tracked running gear, the superstructure having claw brackets, said claw brackets being positioned to allow the undercarriage to turn in order to change the direction of travel of the working machine.

46. The working apparatus of claim 45, said working machine being an excavator.

* * * * *